US005533220A

United States Patent [19]

Sebag et al.

[11] Patent Number: 5,533,220

[45] Date of Patent: Jul. 9, 1996

[54] INFLATABLE, "TELESCOPIC" CELLS FOR CUSHIONS AND MATTRESSES

[75] Inventors: Albert Sebag; Paul Benguigui, both of Nimes, France

[73] Assignee: Askle, Nimes, France

[21] Appl. No.: 492,536

[22] Filed: Jun. 20, 1995

[30] Foreign Application Priority Data

Jan. 13, 1995 [EP] European Pat. Off. ..... 95430001

[51] Int. Cl.[6] ..... A47C 27/08; A47C 27/10

[52] U.S. Cl. ..... 5/654; 5/449

[58] Field of Search ..... 5/455, 449, 654, 5/453, 456

[56] References Cited

U.S. PATENT DOCUMENTS

| | | | |
|---|---|---|---|
| 3,192,540 | 7/1965 | Swank | 5/456 |
| 5,052,068 | 10/1991 | Graebe | 5/464 |
| 5,369,828 | 12/1994 | Graebe | 5/455 |

*Primary Examiner*—Steven N. Meyers
*Assistant Examiner*—Robert G. Santos
*Attorney, Agent, or Firm*—Bacon & Thomas

[57] ABSTRACT

The present invention elates to inflatable cells for cushion and mattress elements, and in particular for medical applications, the elements comprising a soleplate that has a bottom support surface that is plane plus said telescopic cells that extend perpendicularly from and that are fixed to said soleplate in a matrix that covers the top surface of the element, each cell being made out of a flexible material forming an airtight external skin that encloses an internal volume, each of which is in communication with the internal volume of at least one adjacent cell. According to the invention, each of the lateral surfaces in a first opposite pair of lateral surfaces constituting each cell comprises three vertical flats that in the rest position form two concave edges, whereas the other two lateral surfaces of the cell comprise two vertical flats that form a single concave edge in the middle, with at last one of the three-flat lateral surfaces of any one cell facing a two-flat lateral surface of an adjacent cell.

10 Claims, 2 Drawing Sheets

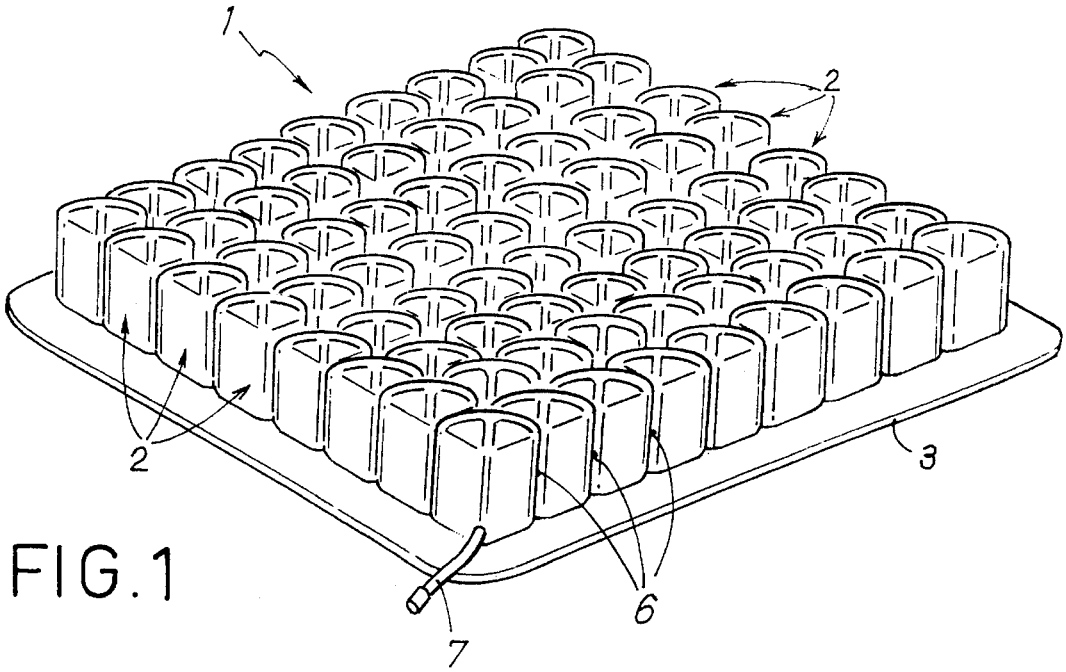
FIG. 1
FIG. 2
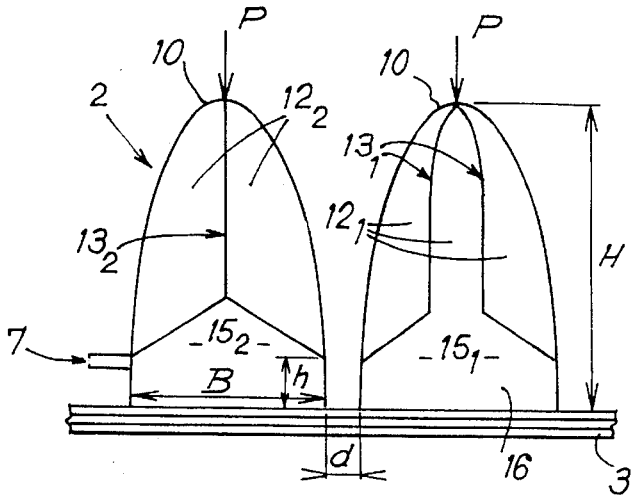
FIG. 3
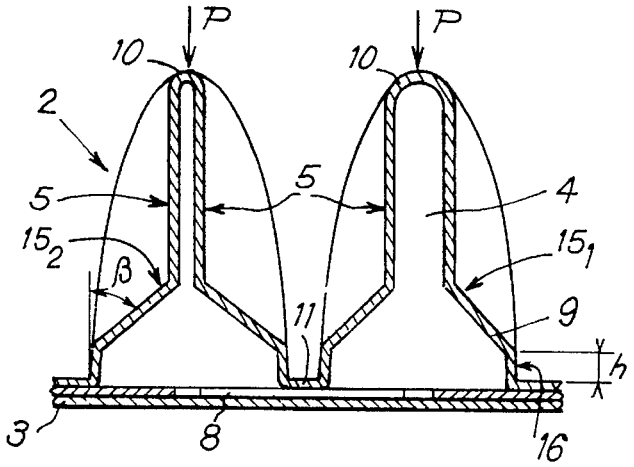

INFLATABLE, "TELESCOPIC" CELLS FOR CUSHIONS AND MATTRESSES

FIELD OF THE INVENTION

The present invention relates to novel inflatable cells for cushions and mattresses, the cells being of the so-called "telescopic" kind.

The technical field of the invention is that of making cushions and mattresses for receiving a person in the sitting position or the prone position.

One of the main applications of the invention is the manufacture of such cushions or mattresses for medical use in order to assist in avoiding bed sores.

BACKGROUND OF THE INVENTION

It is known for such cushions or mattresses to be made by juxtaposing cells that are inflatable from a lower orifice that is subsequently closed, and that are fixed in communication with one another on a support that acts as a sole plate and support for the cushion or mattresses as a whole; said cells are elongate in shape, vertical, perpendicular to said supporting soleplate, disposed adjacent to one another, made of a material that is flexible and airtight, and their outside shape is that of a chuck, preferably a four-faced chuck, each face forming a concave indentation or "recess", even when the cell is preinflated and in a rest position, i.e. in a position when the cushion or mattress is not carrying a load.

When a person sits down or lies down on the cushion or mattress, said cells are compressed and their initially recessed side walls deform under such pressure to come into contact with the side walls of adjacent cells, and this continues until the top walls of the cells also come into contact to form an almost continuous surface that supports the surface of the facing portion of the person's body, and fits closely round said shape; since all of the cells are at the same internal pressure, their volume differences compensate mutually.

Such structures are known and they are referred to as being "multicellular" or as being made up of "telescopic" cells. They have been developed by numerous manufacturers and one of the earliest, Mr. Robert H. Graebe, filed a patent application on May 16, 1973 in the United States, which patent was granted on Mar. 11, 1975 under the U.S. Pat. No. 3,870,450. Thereafter various improvement patents based on that basic patent have been filed, for example U.S. Pat. No. 4,541,136 dated Sep. 17, 1985, which relates to the shape of the cells which have four convex external edges and for concave middle edges, between them defining eight flats simultaneously forming four sides that have indented surfaces plus four ridges, the assembly being symmetrical in shape about a central axis. There is U.S. Pat. No. 4,698,864 of Oct. 13, 1987 which relates essentially to the possibility of certain cells having heights that are different from other cells, as a function of the sitting position. There is U.S. Pat. No. 5,052,068 of Oct. 1, 1991 relating to an improvement that is equivalent to the preceding improvement, in which the cells are still symmetrical, having eight flats that form four ridges and four concave edges in the middles of the four faces, however they are of different shapes. Finally, there is PCT patent WO 92/07,492 published on May 14, 1992 that relates to a particular distribution of air or gas for inflating said cells via a manifold capable of distributing said air or gas into some of the cells in such a manner as to permit different pressures, depending on the zones they occupy in the cushion or the mattress.

Mattresses of the kind described in the earlier patents mentioned above have indeed been manufactured, however those patents were initially taken out for the United States only and at least the earliest of them is now in the public domain, even in the United States.

Various standards also exist in some countries for defining minimum characteristics for such cushions or mattresses, for example the standards laid down in France by the Regional Health Directorate [Direction Régionale de la Santé], and these standards specify, in particular, minimum amounts of crushing, for example: a thickness of not less than 2 cm under the body of the subject, and of at least 3 cm under the thighs of a person prone on the mattress; the mattress should be easy to repair rapidly in the event of tearing since any leakage prevents minimum preinflation of the mattress from providing support by means of a minimum degree of inflation that varies as a function of the weight of the person. The material constituting the walls of the cells in such a cushion or mattress should have a thickness lying in the range 600μ to 800μ, and the wall thickness of the base or soleplate thereof should lie in the range 700μ to 900μ, it should have a breaking strength in both directions of more than 15 MPa and its breaking elongation, likewise in both directions, should be greater than 700%. It should contain a pressure of 50 millibars for more than 48 hours and after spending 24 hours supporting a mass of 90 kg distributed over a 35 cm×35 cm plank of wood for a cushion of similar size, it should enable the cushion to maintain a thickness of more than 2 cm.

Thus, to satisfy such standards, while nevertheless providing maximum comfort and optimum manufacture so as to achieve a cost price that is as low as possible, in particular in countries where social service organizations that pay for or reimburse such cushions or mattresses have ceiling prices imposed on them, various manufacturers have developed various manufacturing techniques using cells of different shapes and materials of different compositions, and they have also developed various improvements for distinguishing their own cushions from those of their competitors. However, most of them still suffer from certain drawbacks and defects, such as the following for example: instability of the preinflated cells which may topple over when a patient bears against them and/or moves on the cushion or mattress, thereby eliminating the effect and the advantage of having such cells; poor transmission between the volumes of air inside the cells which has the effect, particularly when the person moves, of impeding good distribution of pressure such that pressure is no longer uniform; imperfect adhesion between the various elements; flexibility of the material that is too sensitive to temperature, with the material often being too stiff due to manufacturing techniques that involve soaking; great difficulty or even complete impossibility in repairing leaks; poor external airing and air flow between the cells; . . . .

OBJECTS AND SUMMARY OF THE INVENTION

The problem posed is thus to be able to manufacture a cushion or mattress having so-called "telescopic" cells that is made out of a cell-skin material that is as flexible as possible, which flexibility is insensitive to temperature, the shapes of said cells ensuring good vertical stability thereof with the cells being compressed uniformly while simultaneously ensuring that the cells are inflated uniformly with proper pressure distribution; in addition, the disposition of the cells must make it possible for air to move properly from one cell to another when a person supported by the cushion or mattress moves, while nevertheless optimizing manufacture of the cells so as to obtain minimum cost while guaranteeing good performance and ensuring that they can be repaired.

A solution to the problem posed is provided by inflatable telescopic cells for cushion and mattress elements made up of a soleplate having a plane bottom support surface and a plurality of said cells extending perpendicularly from and fixed to said soleplate, the cells being disposed parallel to one another in a matrix that covers the surface of the element and being made of a flexible material constituting an airtight outer skin enclosing an internal volume within each cell, each cell communicating with the internal volume of at least one adjacent cell, said cells being chunk-shaped, having four external edges, and having four lateral surfaces which take up a recessed shape when in a rest position, and when a load is applied to said element by bearing against the ends of the cells which then compress vertically, said surfaces deform so as to come into contact and press against the surfaces of adjacent cells. According to the invention, each cell has two opposite lateral surfaces each constituted by three vertical flats that, in the rest position, form two concave edges, while the other two lateral surfaces of the same cell are each constituted by two vertical flats that form a single concave edge in the middle, at least one of the three-flat lateral surfaces of each cell being disposed facing a two-flat lateral surface of an adjacent cell.

Preferably, their dimensions present a ratio between their base and their height lying either in the range 37% to 45%, for a height lying in the range 95 mm to 105 mm, either; or else lying in the range 57% to 65% for a height lying in the range 60 mm to 70 mm and a distance between adjacent bases of not less than 8 mm, with the density of cells per square meter ($m^2$) lying in the range 350 to 450; the angle $\alpha$ formed between the two inclined flats of a two-flat lateral surface in each cell is 120°, and in addition the vertical flats of their lateral surfaces are hinged at their bottom ends to sloping flats which are themselves hinged to a cylindrical base.

In a preferred embodiment, the material constituting the skin of the cells has a thickness lying in the range 5/10ths of a millimeter to 7/10ths of a millimeter and is made from polychloroprene latex filled with less than 25% inorganic material using a mixture of two types of elastomer at a ratio of 40% to 60% each to make up a 100% mixture: by way of example, it is possible to choose two types of neoprene referenced in standard manner from the products manufactured by Du Pont de Nemours, such as Neoprene 671 and Neoprene 750; such choices ensuring a minimal amount of crystallization, thereby guaranteeing that the finished product is highly flexible at any temperature, whereas under normal circumstances polychloroprenes lose their elastic qualities below 10° C., which is why manufacturers have, in the past, added oil in order to retain flexibility even when cold, however such addition of oil reduces the strength properties of the material, and in particular reduces the traction strength of joints made with adhesive.

Furthermore, for the purpose of inflating an element of the cushion or mattress, at least one of said cells, preferably a cell situated in the corner of said element, includes an inflation endpiece fixed thereto and opening out into one of the external edges of said cell and situated at a distance from the base of the cell that is not less than 8 mm, i.e. the soleplate of the element or of the cushion.

It is known that communication between the internal volumes of the cells is achieved by a balancing channel situated in the soleplate, which channel may be provided by omitting adhesive between the skins of the cells and the soleplate at particular locations where they meet; in the present invention, in order to ensure that air moves as slowly and as smoothly as possible, when a person on said cushion or mattress moves, thereby avoiding instability as can occur in certain prior art cushions, said channel, at least in the direction of one of the dimensions of said cushion or mattress, is such that it interconnects no more than three adjacent cells in a straight line, and that any portion of said channel that interconnects two cells situated on two opposite sides as defined by said dimension of the element passes through at least 3n/2 cells where n is the number of cells occupying said dimension.

In a preferred embodiment, for a cushion element having dimensions of 400 m×450 mm, for example, the cushion may have no more than 72 cells organized in an 8×9 matrix, for example, and the various skins of material constituting the cells and the soleplate are stuck to one another to have a breaking force in traction equal on a given sample section to at least 40% that of the material constituting the skins on its own, e.g. as achieved in particular by a specific choice for said material, with an example being given above.

The result is to provide novel types of inflatable telescopic cells for cushion or mattress elements, which cells include various characteristics that satisfy the problem posed.

The shape and the specific asymmetric outline of telescopic inflatable cells of the invention, and the ratio of their dimensions to their density per $m^2$, serves to provide said cells with stability that is greater than that obtained in prior art cushions or mattresses, thereby ensuring good stability of the load and thus of a person resting and possibly moving thereon, while nevertheless satisfying the standards laid down in this field.

The ten-flat configuration of the set of faces making up the cells giving six concave edges instead of four, as in prior art cells, provides better support by the cells interacting somewhat by their alternating disposition in which a two-flat side surface of one cell faces a three-flat side surface of an adjacent cell: said surfaces are then better secured relative to one another and provide the cells with better stability than is the case in prior art cushions; and this effect is increased in that the ratios of cell dimensions and density per $m^2$are expressed as different percentages which means that in prior art cushions the cells are much more elongated vertically, thereby giving rise to a certain amount of instability; furthermore, the minimum space used in the present invention between said cells is 8 mm at least and 10 mm at most, with this being made possible by the choice of size ratios specified above: this minimum space is thus large enough firstly to enable good airing and cleaning, and secondly to facilitate manufacture by soaking and by casting substance into molds.

Furthermore, the above choice of polychloroprene material makes it possible to obtain better performance during soaking, during use, and during molding of said skin in order to make said cells, thus making it possible to conserve flexibility for the material, whereas for many prior art cushions, the skin is rather stiff after manufacture; in the present invention, the flexibility is obtained, in particular, because of the minimal inorganic fill in the polychloroprene; furthermore, as already mentioned, this characteristic of flexibility and the flexibility obtained even while cold by an appropriate choice of mixture of two types of elastomer, and also the breaking strength of the material, are retained even after aging, e.g. at 70° C. for 7 days, with breaking elongation being more than 650%, breaking strength being greater than 15 MPa, whereas under the same conditions, many other materials harden, which is detrimental, both for the user and also for the manufacturer when sticking the skin constituting said cells on the supporting soleplate.

In addition, the particular implementation of mutual communication and connection between the internal volumes of the cells, by means of lengthening the communication circuits between them, makes it possible to distribute pressure more slowly as air moves from one cell to another, in particular when a person on the cell moves, thereby improving the above-mentioned quality of stability.

Other advantages of the present invention could be mentioned, but those given above suffice already to demonstrate the advantages and novelty of the invention.

BRIEF DESCRIPTION OF THE DRAWINGS

The following description and the accompanying drawings relate to a particular embodiment of the invention that has no limiting character: other embodiments are possible within the scope and the extent of the invention.

FIG. 1 is a perspective view of a cushion element of the invention in a preinflated state.

FIGS. 2 and 3 are a profile view and a section view of two adjacent cells of the invention in a cushion element.

MORE DETAILED DESCRIPTION

Figure 6:
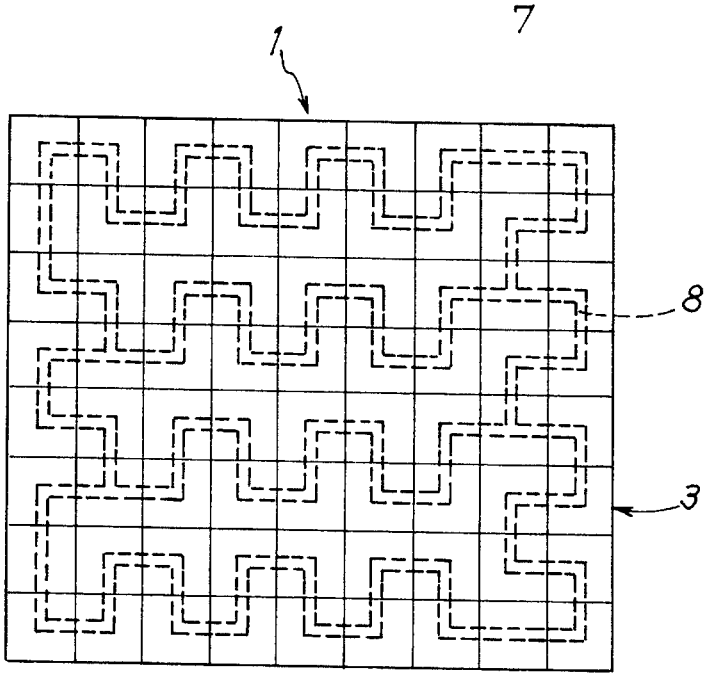
FIG. 6 is a plan view of the soleplate of a cushion element of the invention.

The various accompanying figures show complete mattress or cushion elements or else portions thereof, it being understood that as shown in FIGS. 1 and 6, the invention relates to cushions that may have dimensions of the order of about 400 mm to 450 mm, and are thus suitable for use singly as a cushion placed on any seat; by uniting a plurality of such elements by any appropriate linking system, it is possible to form areas that are much larger, e.g. constituting a mattress on which a person can lie down.

Figure 4:
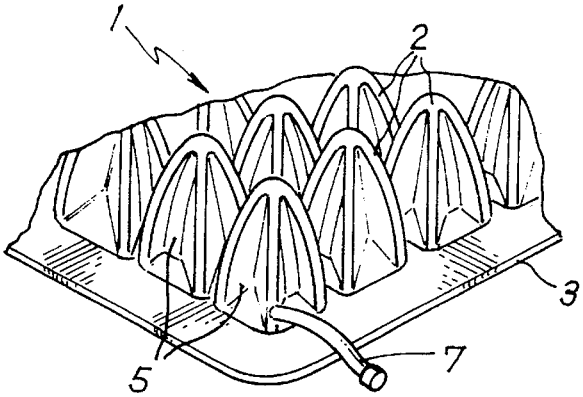
FIG. 4 is a fragmentary view of the cushion element of FIG. 1 in its deflated and rest position.

Such a cushion or mattress element is thus constituted in conventional manner by a soleplate 3 providing a bottom supporting surface that is plane, and telescopic cells 2 that are perpendicularly elongate, and that are fixed to said soleplate in parallel rows constituting a matrix that covers the top surface of the element 1. The cells are made of flexible material that forms an airtight external skin 9 enclosing an internal volume 4 for each cell. The various internal volumes 4 communicate with the internal volume of at least one adjacent cell, and said cells 2 are chuck-shaped, each having four outside edges 14 and each having four side surfaces 5 which, in a rest position as shown in FIG. 4, are recessed. When a load is applied to said element 1 by bearing against the ends 10 of the cells 1, the cells compress vertically and said surfaces deform so as to come into contact with one another at 6, as shown in FIG. 1 (even though this figure does not show the load, the deformation therein being obtained by preinflation). After making contact 6, said surfaces 5 bear against the surfaces of the adjacent cells.

Figure 5:
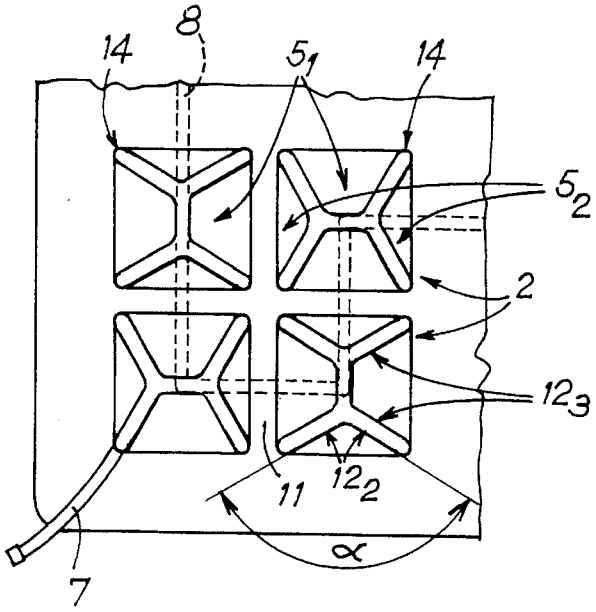
FIG. 5 is a plan view of the portion of cushion shown in FIG. 4.

FIGS. 2 and 3 are a profile view and a section view corresponding to the profile showing two adjacent cells 2 of a cushion element of the kind shown in FIG. 1, but in a deflated state, as also shown in FIGS. 4 and 5.

Said cells 2 thus in a rest position and while not preinflated therefore have their lateral surfaces 5 in a recessed configuration, and since there are four such surfaces, the cells form four-faced chuck-shaped bodies with said internal volumes 4 being in a minimum-dimension position.

As will be well understood from the plan view of FIG. 5, two of the opposite lateral surfaces $\mathbf{5}_1$ in each cell 2 are made up of three vertical flats $\mathbf{12}_1$, together forming two concave edges $\mathbf{13}_1$ while in the rest position, while the other two lateral surfaces $\mathbf{5}_2$ of the same cell 2 are constituted by two vertical flats $\mathbf{12}_2$, thus forming a single middle concave edge $\mathbf{13}_2$. At least one of the three-flat lateral surfaces $\mathbf{5}_1$ of each cell is disposed facing a two-flat lateral surface $\mathbf{5}_2$ of an adjacent cell, in a configuration that can be said to be alternating.

In FIG. 3 it can readily be seen that by inflating the internal volume 4 via a feed and balancing channel 8 situated in the thickness of the soleplate 3 and conveying air either as blown in from an endpiece 7 or else coming from adjacent cells in the event of a pressure or a load P being applied to the ends 10 of said cells, the walls 5 of the inflated cell move away from its axis so as to come closer to the walls 5 of the adjacent cells. When the external pressure P as transmitted by the load to be supported is in equilibrium with the internal pressure of the cells, then all of the walls 5 make contact with their neighbors and press one against another, in other words each edge $\mathbf{13}_2$ of a two-flat surface is received between the two concave edges $\mathbf{13}_1$ of the facing three-flat surface of the adjacent cell, thereby providing improved interlocking between the cells. The final heights of the various cells correspond to the outside shape of the load applied to the cushion element, thereby adapting to the profile thereof without any local excess pressure or point excess load, and that makes it possible to avoid bed sores.

As shown in FIG. 5, in a particular embodiment, the angle $\alpha$ formed between the two sloping flats $\mathbf{12}_2$ constituting a two-flat lateral surface $\mathbf{5}_2$ is 120°, whereas the angle formed between the outermost vertical flats $\mathbf{12}_3$ of the three-flat surfaces is 60°.

As shown in FIGS. 2 and 3, the vertical flats $\mathbf{12}_1$ and $\mathbf{12}_2$ of the lateral surfaces $\mathbf{5}_1$ and $\mathbf{5}_2$ of each cell 2 are hinged at their bottom ends to sloping flats $\mathbf{15}_1$, $\mathbf{15}_2$ which are themselves hinged on a cylindrical base 16, thereby providing increased stability for the bases of said cells relative to the soleplate 3 that carries them, and regardless of inflation pressure. This configuration also reduces risks of tearing at the corners that deform due to movement when pressure varies, even in the event of a possible leak, since this configuration achieves better distribution given that none of the angles constituting hinges between flats in the deformable surfaces is situated on the soleplate 3 where proper distribution is much more difficult to achieve.

Similarly, for various reasons including a similar purpose of reduced risk of tearing, at least one of the cells 2, and in particular the cell situated in a corner of the cushion element, has an inflation endpiece 7 which is fixed and which opens out into one of the external edges 14 of said cell 2, while being situated at a vertical distance h from the base thereof, where h is not less than 8 mm and preferably corresponds to the top of the cylindrical vertical base 16 of the cell.

FIG. 1 thus shows said cells 2 in a preinflated state due to the inflation endpiece 7 which is situated in the corner of a cell, which cell is itself situated in one of the corners of the cushion element. However, it would naturally be possible for the endpiece to be situated in the soleplate 3, as is the practice with other cushions, even though such a situation is not recommended with the present invention. For normal use, preinflation to a given pressure is determined as a function of the weight of the load to be supported on said cushion or mattress element, e.g. in order to ensure that there is still a minimum height of 3 cm when such cells are maximally deformed, as is laid down by French standards. The pressure inside the cells then compensates the weight that they have to support. Furthermore, because of the disposition and the special shapes of their surfaces which come into contact, said cells are highly stable. Nevertheless it is clear that if the cells are insufficiently inflated so that they do not come into contact with one another, then in spite of having the specific shape of the invention, they would be deflected from their vertical axes, thereby giving rise to instability and to discomfort, together with an associated risk of bed sores. The way in which pressure is selected as a function of the weight of a load can be determined in conventional manner and does not need to be described further in the present description.

In accordance with the invention, in order to guarantee as well as possible optimum stability of the various cells relative to one another, and in order to achieve better contact between them for load-distributing purposes, the dimensions of said cells 2 have a ratio between their bases B and their heights H lying in the range 57% to 65% for cushion elements of the thin type, in other words between 60 mm and 70 m in the rest position together with a distance "d" between adjacent bases of at least 8 mm, and with cells being packed at a density of 350 to 450 cells per square meter. For cushions of greater thickness, e.g. in the range 95 mm to 105 mm, which therefore require cells of greater height, the above ratio lies, in the present invention, in the range 37% to 45%.

Thus, by way of example, the base B of the cells 2 may be a square having a side lying in the range 38 mm to 42 mm, the height of the cells in a thin cushion element may be 65 mm, and in a thick cushion element the height thereof may be about 100 mm.

FIG. 4 is a fragmentary view of the cushion of FIG. 1, however it is shown in its rest and deflated state, like the cells shown in FIGS. 2 and 3, and FIG. 5 is a plan view of the same portion of the cushion of FIG. 4 but also showing, in dashed lines, the balancing channel between said cells 2, which channel may be implemented in known manner by a grid which prevents the soleplate 3 adhering to the skin 9 of the cells at their junctions 11.

As indicated above, in order to slow down the balancing effect between the various cells due to air being transmitted from one to another, and thus in order to achieve better stability when a person sitting or lying on said cushion or mattress elements moves, said channel 8, as shown in FIG. 6, and at least in the direction of the general dimensions of said cushion or mattress, is such as to interconnect no more than three adjacent cells 2 that are in a straight line. In addition, the full length of the channel 8 interconnecting two cells 2 situated at two opposite ends of said dimension of the element 1 runs through at least 3n/2 cells where n is the number of cells occupying said dimension.

For a rectangular cushion as shown in the examples of the accompanying figures, said dimensions are thus the width and the length thereof, and the corresponding matrix formed by the cells may be of the 8×9 type giving 72 cells 2, each having the shape of a four-faced chuck, as shown in FIGS. 1 to 5.

Thus, in the length direction which therefore has 9 cells, the ratio (3n/2)=27/2=13.5, i.e. less than 14 cells. This is true of each of the four links shown in FIG. 6 that run from left to right, where the top and bottom links interconnect 15 cells and the two middle links do indeed interconnect 14 cells.

In the width direction, i.e. vertically in FIG. 6, there are 8 cells so the ratio 3n/2=12, and indeed the left and right end links in FIG. 6 do indeed have 12 cells between the bottom portion shown in the figure and the top portion in the width direction of the element 1.

As mentioned above, the material constituting the skin 9 of the cells is preferably 5/10ths of a millimeter to 7/10ths of a millimeter thick, i.e. preferably 6/10ths of a millimeter thick, and it is made from a mixture of two neoprene type polychloroprene latexes having a fill of less than 25% inorganic material. In addition to the qualities already mentioned for such a choice of materials, and in particular better soaking strength during manufacture of said skin by molding so as to obtain cells 2 of the special shape as defined above, another advantage is better adhesion between the various skins constituting the cells 2 and the soleplate 3. In particular, a breaking force in traction is obtained that is equal, for a given sample, to at least 40% of the breaking strength of the material on its own from which said skins are made. During tests performed in application of French standard NF T 54 122, i.e. performed by pulling on strips cut out from skins stuck together over a width of 25 mm, with a traction force of at least 60N being applied thereto, and in fact with a traction force of 70N being applied in the tests performed, a result of 61.8% of the breaking traction strength was obtained relative to the breaking force required for the material on its own without adhesive.

Other tests have also been performed on such material in application of various other standards, and they have shown that a breaking strength of better than 15 MPa can be obtained, and in particular a strength of 19 MPa, with elongation on breaking being greater than 700%, and sometimes being as great as 820%. After aging for 7 days at 70° C., the breaking strength obtained was greater than or equal to 17 MPa and the breaking elongation was still greater than or equal to 650%.

The gas permeability coefficients of neoprene as defined at 25° C. are, for hydrogen: $10.8\times10^{-8}$ $cm^2$/second×atmosphere; for oxygen: $3\times10^{-8}$ $cm^2$/second×atmosphere; for nitrogen: $0.89\times10^{-8}$ $cm^2$/second×atmosphere; and for carbon dioxide 19.4 $cm^2$/second×atmosphere; and at 50° C., the same gases enable the following respective permeability coefficients to be obtained: 28.5, 10.1, 3.5, and 56.5 $cm^2$/second×atmosphere.

We claim:

1. Inflatable telescopic cells for cushion and mattress elements made up of a soleplate having a plane bottom support surface and a plurality of said cells extending perpendicularly from and fixed to said soleplate, the cells being disposed parallel to one another in a matrix that covers the surface of the element and being made of a flexible material constituting an airtight outer skin enclosing an internal volume within each cell, each cell communicating with the internal volume of at least one adjacent cell, said cells being chuck-shaped, having four external edges, and having four lateral surfaces which take up a recessed shape when in a rest position, and when a load is applied to said element by bearing against the ends of the cells which then compress vertically, said surfaces deform so as to come into contact and press against the surfaces of adjacent cells, wherein each cell has two opposite lateral surfaces each constituted by three vertical flats that, in the rest position, form two concave edges, while the other two lateral surfaces of the same cell are each constituted by two vertical flats that form a single concave edge in the middle, at least one of the three-flat lateral surfaces of each cell being disposed facing a two-flat lateral surface of an adjacent cell.

2. Inflatable cells according to claim 1, wherein their dimensions present a ratio between their base and their height lying in the range 37% to 45%, for a height lying in the range 95 mm to 105 mm, and a distance between adjacent bases of not less than 8 mm, with the density of cells per square meter lying in the range 350 to 450.

3. Inflatable cells according to claim 1, wherein their dimensions present a ratio between their base and their height lying in the range 57% to 65%, for a height lying in the range 60 mm to 70 mm, and a distance between adjacent bases of not less than 8 mm, with the density of cells per square meter lying in the range 350 to 450.

4. Inflatable cells according to claim 1, wherein the material constituting the skin of the cells has a thickness lying in the range 5/10ths of a millimeter to 7/10ths of a millimeter and is made from polychloroprene latex filled with less than 25% inorganic material.

5. Inflatable cells according to claim 1, wherein at least one of the cells includes an inflation endpiece fixed thereto and opening out into one of the external edges of said cell and situated at a distance from the base of the cell that is not less than 8 mm.

6. Inflatable cells according to claim 1, wherein the angle $\alpha$ formed between the two inclined flats of a two-flat lateral surface in each cell is 120°.

7. Inflatable cells according to claim 1, wherein the vertical flats of their lateral surfaces are hinged at their bottom ends to sloping flats which are themselves hinged to a cylindrical base.

8. Cushion and mattress elements constituted by cells according to claim 1, in which communication between the internal volumes of the cells is provided by a balancing channel situated in the soleplate, wherein said channel, at least in the direction of one of the dimensions of said cushion or mattress, is such that it interconnects no more than three adjacent cells in a straight line, and that any portion of said channel that interconnects two cells situated on two opposite sides as defined by said dimension of the element passes through at least 3n/2 cells where n is the number of cells occupying said dimension.

9. Cushion or mattress elements constituted by cells according to claim 1, and having dimensions of no more than about 400 mm×450 mm, comprising 72 cells disposed in an 8×9 matrix.

10. Cushion or mattress elements constituted by cells according to claim 1, wherein the various skins constituting the cells and the soleplate are stuck together so as to provide a breaking traction force equal to not less than 40% that of the material on its own from which said skins are formed.

* * * * *